US006984797B2

(12) United States Patent
Morita et al.

(10) Patent No.: US 6,984,797 B2
(45) Date of Patent: Jan. 10, 2006

(54) PUSH-BUTTON SWITCH

(75) Inventors: Kazuaki Morita, Hikawa-gun (JP); Kokichi Tobita, Ohara-gun (JP); Yoshikazu Hirai, Otsu (JP); Teruyuki Mine, Ibaraki (JP); Tadashi Sato, Ibaraki (JP)

(73) Assignees: OMRON Corporation, Kyoto (JP); Fujitec Co., Ltd., Osaka (JP)

( * ) Notice: Subject to any disclaimer, the term of this patent is extended or adjusted under 35 U.S.C. 154(b) by 0 days.

(21) Appl. No.: 10/869,258

(22) Filed: Jun. 15, 2004

(65) Prior Publication Data

US 2004/0256210 A1 Dec. 23, 2004

(30) Foreign Application Priority Data

Jun. 19, 2003 (JP) ..... 2003-174428

(51) Int. Cl.
*H01H 9/18* (2006.01)

(52) U.S. Cl. ..... 200/314; 200/344

(58) Field of Classification Search ..... 200/310–317, 200/344, 345, 517, 5 A; 341/22
See application file for complete search history.

(56) References Cited

U.S. PATENT DOCUMENTS

| | | | | |
|---|---|---|---|---|
| 4,778,966 | A * | 10/1988 | Obata et al. | 200/314 |
| 5,373,132 | A * | 12/1994 | Achermann et al. | 200/310 |
| 5,434,377 | A * | 7/1995 | Martin et al. | 200/314 |
| 6,417,469 | B1 * | 7/2002 | Tamura | 200/314 |
| 6,633,012 | B2 * | 10/2003 | Hsu | 200/344 |
| 6,713,700 | B2 * | 3/2004 | Hsu | 200/344 |

* cited by examiner

*Primary Examiner*—Michael A. Friedhofer
(74) *Attorney, Agent, or Firm*—Beyer Weaver & Thomas LLP

(57) ABSTRACT

A push-button switch has a plunger to be pressed so as to activate its main body supported by a base member. A cap serving as a pressing member is on an outer edge portion of the plunger. The outer periphery of the cap is surrounded by a frame part of a lens member made of a transparent resin material such that the light from a light source disposed near the center of the plunger is guided to the upper edge part of the frame part.

15 Claims, 9 Drawing Sheets

PUSH-BUTTON SWITCH

Priority is claimed on Japanese Patent Application P2003-174428 filed Jun. 19, 2003.

BACKGROUND OF THE INVENTION

This invention relates to a push-button switch and more particularly to a push-button switch of an illuminating type which may be set conveniently on a wall surface beside the entrance to an elevator for indicating an upward or downward direction.

As disclosed in FIGS. 2 and 3 of Japanese Patent Publication Tokkai 11-314861, for example, a push-button switch is generally structured such that a switch main body is activated as the operating surface of the push-button is pressed so as to push and displace a plunger and contains an illuminator using a light source such as an LED for displaying that the switch main body has been activated.

With a prior art bush-button switch thus structured, a relatively large number of LEDs are usually employed as light sources in order to illuminate the whole of the operating surface of the push-button and it has been one of the causes of its high production cost.

The plunger of such a prior art bush-button switch is adapted to be guided by means of a fixed guide member when it is pushed and displaced as the push-button is pressed. This guide member is required to be adapted to guide the plunger over a relatively long distance in order to be able to displace the plunger slidingly even when only an edge portion of the operating surface of the push-button is pressed. This tends to make the switch thicker as a whole.

SUMMARY OF THE INVENTION

It is therefore an object of this invention to provide a push-button switch using a relatively small number of light sources but capable of providing illuminations with an improved design.

It is another object of the invention to provide such a push-button switch capable of carrying out the switching operations properly even when only an edge portion of the operating surface of the push-button is pressed, while its thickness is prevented from increasing.

A push-button switch embodying this invention may be characterized as comprising a switch main body supported by a base member, a pressing member having an operating surface with an outer periphery, a plunger connected to the pressing member for activating the switch main body by a pressing operation on the pressing member in an operating direction, a light source, and a light-guiding member having a frame part that surrounds the outer periphery of the operating surface for guiding light from the light source to the frame part. With a push-button switch thus structured, the light from the light source is guided to the frame part which surrounds the operating surface of the pressing member and hence the so-called frame illumination is effected, and since the light-guiding member serves to guide the light from the light source towards the outer periphery, it is sufficient to have a light source near a center part and hence the number of required light sources can be reduced.

The light source may be disposed opposite a center part on a back surface of the operating surface of the pressing member, the light-guiding member being disposed between the light source and the back surface, and the light-guiding member may comprise a transparent resin material. In this manner, the light from the light source can be effectively guided to the frame part on the outer peripheral part by means of a lens member disposed between the light source and the back surface of the pressing member. The light source may comprise a single chip LED or two of them disposed next to each other opposite the center part of the back surface of the pressing member.

The light-guiding member may be provided with a reflecting surface which reflects the light from the light source and guide it to the frame part such that the light from the light source can change the direction of its propagation by this reflecting surface so as to be guided efficiently to the frame part.

The light-guiding member may have a tapered opening serving as the reflecting surface so as to reflect the light from the light source to an outer peripheral part of the back surface. Such an opening may be a throughhole or a mere indentation without completely penetrating the member. With such an opening, the light from the light source disposed opposite the center part of the back surface of the pressing member is reflected by the tapered opening as it is guided to the frame part on the outer periphery of the pressing member.

Preferably, the light-guiding member has a tapered surface on an outer peripheral part, serving as the reflecting surface and reflects the light reflected by the tapered opening and guided to the outer peripheral part of the back surface to the side of the operating surface. In this manner, the light from the light source at the center is reflected by the tapered opening and guided to the frame part on the outer peripheral part and this light can be further reflected by this tapered surface so as to be guided from the side of the back surface to the side of the operating surface.

According to another preferable embodiment, the light-guiding member has an indentation surrounded by the frame part, the pressing member is contacted to the indentation, and the back surface of the pressing member and the indentation in the light-guiding member are each provided with a positioning mark. With such marks provided, the pressing member can be positioned correctly into the indentation of the light-guiding member by matching these marks.

The plunger and the light-guiding member may be integrally formed as a single unit, both comprising the same light-guiding material. This embodiment is advantageous because a dedicated lens member may be dispensed with and hence the number of components to be assembled and the work steps can be reduced.

A link mechanism for displacing the plunger properly in its operating direction may be structured so as to comprise a first lever and a second lever both with one end supported by the base member and the other end connected to the plunger and being assembled with their middle parts crossed and their other ends being allowed to be displaced in the operating direction while remaining parallel to the one end. One of these levers may be provided with a spring member adapted to be elastically deformed as the plunger is displaced. With a link mechanism thus structured, the two levers form a mechanism adapted to move while maintaining a parallel orientation. The other ends of the levers connected to the plunger are displaced in the direction of the operating direction while remaining parallel to the end parts supported by the base member and hence the switch can be made relatively thin and the plunger manages to be displaced in the intended direction even if the pressing member is pressed only at one corner position. Since an elastically deformable spring member is provided, furthermore, the user obtains a suitable clicking sensation.

The aforementioned first and second levers may each comprise a first arm part, a second arm part, a third arm part and a fourth arm part that are sequentially connected and together form a rectangular shape, the first arm part being at the one end, the third arm part being opposite the first arm part and at the other end, the first lever and the second lever being assembled together by being crossed at center parts of the second arm parts and the fourth arm parts such that the third arm part of one of these levers is positioned between the first arm part and the third arm part of the other of these levers, these levers being biased by return springs against the pressing operation, the plunger being detachably connected to the third arm parts of both of these levers and displaced in the operating direction as the third arm parts move upward and downward, the base member having a container part inside a region partitioned by both of the assembled levers for removably containing therein a circuit board to which the light source is mounted. With levers thus structured, a sufficient strength can be maintained due to their rectangular formation while the space inside the two levers are wisely utilized to contain the circuit board to which the light source for illumination may be mounted. Since both the plunger and the circuit board are removable, a maintenance work can be easily effected on the switch.

A leaf switch may be provided on a back surface of the circuit board for serving as a main body of the push-button switch. The leaf switch may have an operation piece that is operated by the third arm part of either of the two levers. With such a leaf switch, both surfaces of the circuit board can be effectively utilized and the board can be easily miniaturized. Since the levers are both biased to the return direction, the operation piece of the leaf switch may be positioned on the third arm part such that the junction point is switched off at the return time and switched on at time of the pressing operation.

The aforementioned spring member may be disposed between the first arm part of one of the levers and the third arm part of the other of the levers and may be adapted to have the biasing direction inverted as the third arm part is displaced by the pressing operation of the plunger. In this manner, the user obtains a good clicking sensation as the button is pressed.

DETAILED DESCRIPTION OF THE INVENTION

Figure 1:
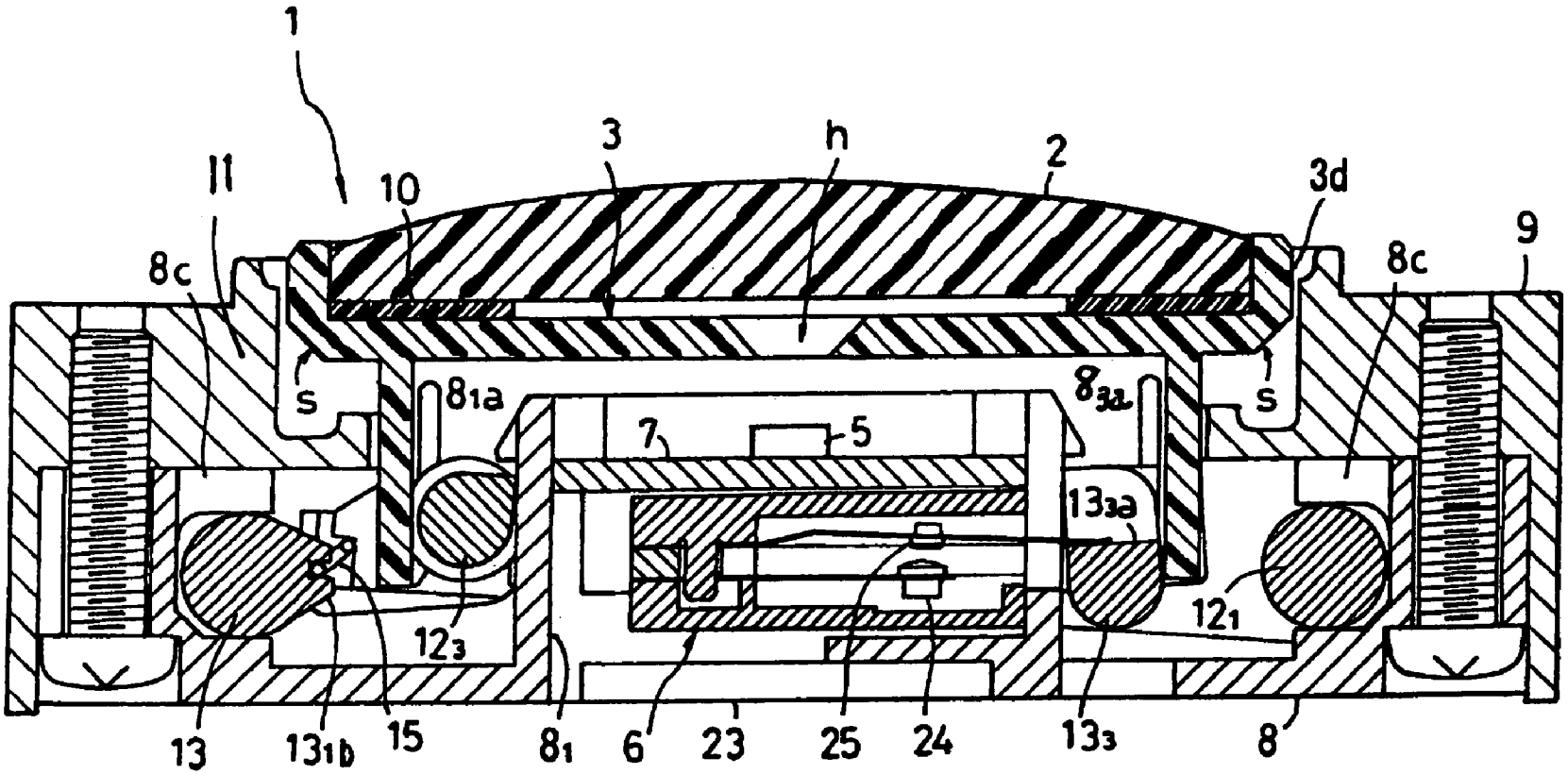
FIG. 1 is a sectional view of a push-button switch embodying this invention.
Figure 2:
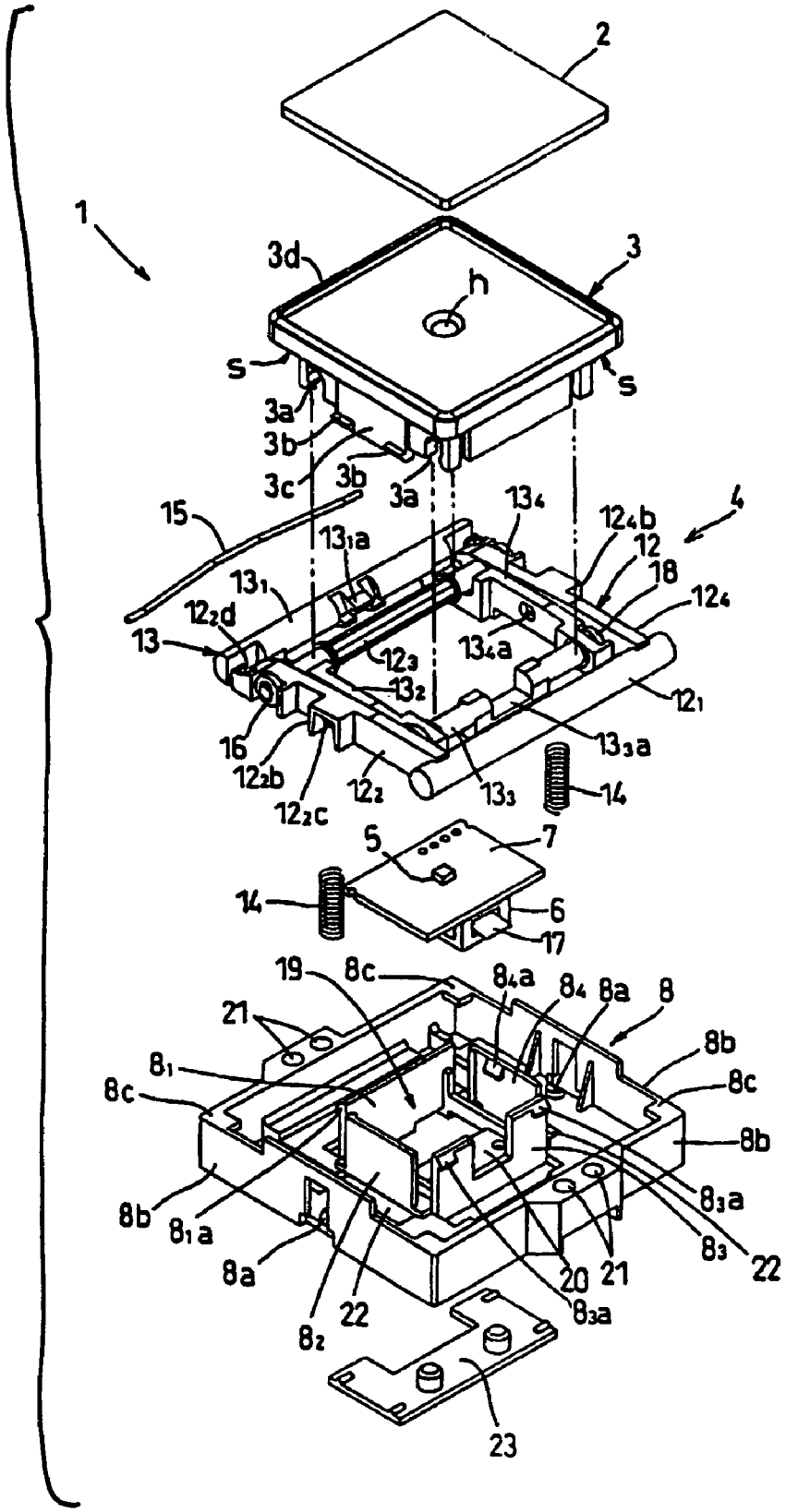
FIG. 2 is an exploded diagonal view of the push-button switch of FIG. 1.

The invention is described next by way of an example. FIG. 1 is a sectional view of a push-button switch 1 embodying this invention and FIG. 2 is its exploded diagonal view. This push-button switch 1 is of the illumination type adapted to be used as an indicator switch for an elevator for indicating the upward or downward direction and to be set conveniently on a wall surface beside the entrance to the elevator.

As basic components, this push-button switch 1 is provided with a plunger 3 having a cap 2 attached thereto, a link mechanism 4 to be described below for displacing the plunger 3 in the direction of operation (the up-down direction in FIG. 1) without tilting it, a circuit board 7, a base member 8 for containing the circuit board 7, the link mechanism 4 and a cover 9 which engages and is screwed to the base member 8 from outside. The cap 2 serves as a pressing member having an operating surface. The circuit board 7 has electronic components such as a chip LED 5 serving as the illuminating light source mounted to its front surface.

The plunger 3 may comprise a transparent resin material such as polycarbonate so as to be able to serve as a light-guiding member for guiding light from the chip LED 5 and may be provided with a frame structure 3*d* protruding upward from the upper edges of its periphery. The cap 2 is fitted into the indentation formed by this frame structure 3*d* and is adhesively fastened to it by means of an adhesive tape 10. In other words, this frame structure is for the purpose of surrounding the outer periphery of the cap 2 from outside and it is not the entirety of the operating surface of the cap 2 that is intended to be illuminated. Instead, what is illuminated is the peripheral frame structure 3*d* such that a so-called frame-type illumination with an improved design can be carried out.

For this purpose, the plunger 3 is provided at its center with a tapered opening h forming a reflecting surface which expands upward so as to serve as a light-guiding member for light from the chip LED 5. The chip LED 5 is disposed at the deeper end of this opening h such that the light therefrom undergoes total reflections on the peripheral surface of the tapered opening h so as to be directed outwardly towards the outer periphery. The sloping angle of this tapered opening h is preferably about 45° such that the light from the chip LED 5 disposed at the center can be efficiently reflected towards the frame structure 3*d* on the periphery of the cap 2. The tapered opening h may be formed so as to become wider in the downward direction. It need not necessarily be a throughhole and may merely be a tapered indentation.

Tapered surfaces s are further provided at the corners on the bottom edge of the frame structure 3*d* of the plunger 3 such that the light which has undergone total reflection on the tapered opening h and been guided to the outer periphery is further caused to undergo total reflection on these tapered surfaces s and is guided to the upper edge portions of the frame structure 3*d*. The sloping angle of these tapered surfaces s is also preferably about 45° such that the light from the backside of the cap 2 can be efficiently guided to the upper side for the operation. These tapered surfaces s are not essential, however, and may be omitted.

A white reflecting surface is formed by pasting a film or by printing on the backside of the operating surface of the cap 2 such that the light which has passed through the tapered opening h is efficiently reflected into the material of the plunger 3 and guided to the frame structure 3*d*.

Thus, the plunger 3 has the function of reflecting the light from the single chip LED 5 at the center on the tapered opening h and the tapered surfaces s so as to guide it to the entire peripheral areas on the upper edge of the frame structure 3*d*. With the plunger 3 thus structured, as the cap 2 is pressed to thereby activate a leaf switch 6 through the plunger 3, as will be explained below, the light from the chip LED 5 is guided to the frame structure 3*d* surrounding the outer periphery of the operating surface of the cap 2 for an effective frame illumination to illuminate the surrounding areas of the cap 2.

At each of four corner positions on the lower surface of the plunger 3, an indentation 3*a* is extensively formed for disengageably engaging to first and second levers 12 and 13 to be described below of the link mechanism 4. Two hooks 3*b* for engaging the cover 9 and preventing the plunger 3 from sliding out upwards are formed on both sides (although only the one on one side is shown in FIG. 2).

As explained above, the link mechanism 4 is for allowing the plunger 3 having the cap 2 mounted thereto to be displaced in the direction of operation without tilting and is provided not only with a first lever 12 and a second lever 13 but also two return springs 14 and a wire-shaped sensing spring 15 for giving the operator a clicking sensation at the time of pressing. As better seen in FIG. 3, the levers 12 and 13 are approximately rectangular, having their arm parts $\mathbf{12}_1$–$\mathbf{12}_4$ and $\mathbf{13}_1$–$\mathbf{13}_4$ continuously around. The first arm mart $\mathbf{12}_1$ at one end of the first lever 12 is slidably and rotatably received and supported on one side of the rectangular base member 8, and the third arm part $\mathbf{12}_3$ with a circular cross-sectional shape on the other end is engagingly connected to an indentation 3*a* on the plunger 3. The first arm part $\mathbf{13}_1$ at one end of the second lever 13 is slidably and rotatably received and supported on the opposite side of the base member 8, and the third arm part $\mathbf{13}_3$ with a circular cross-sectional shape on the other end is engagingly connected to the indentation 3*a* on the plunger 3.

Figure 3:
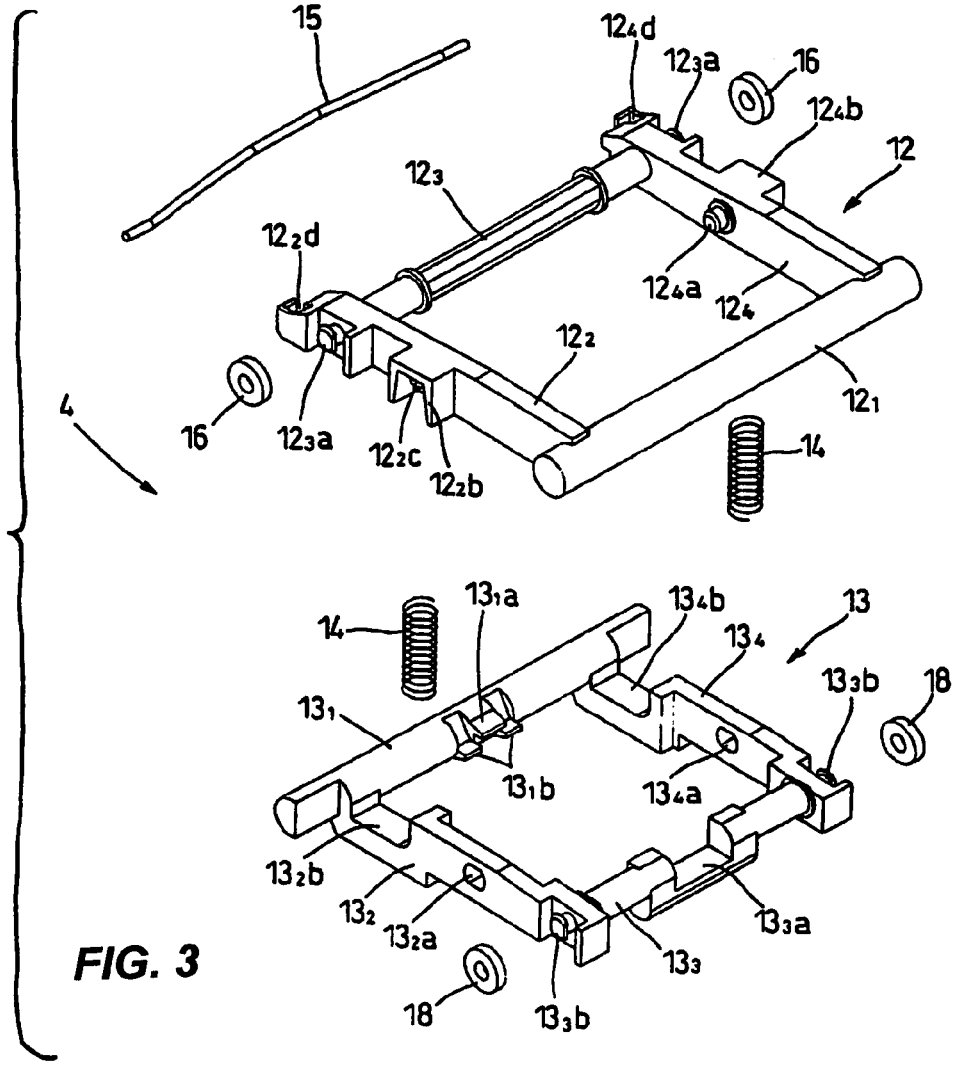
FIG. 3 is an exploded diagonal view of the link mechanism of FIG. 2.

Inward protrusions $\mathbf{12}_{2a}$ and $\mathbf{12}_{4a}$ are formed on the middle parts of the mutually opposite second and fourth arm parts $\mathbf{12}_2$ and $\mathbf{12}_4$ (only one of them being shown in FIG. 3). The mutually opposite second and fourth arm parts $\mathbf{13}_2$ and $\mathbf{13}_4$ of the second lever 13 are provided with laterally elongated openings $\mathbf{13}_{2a}$ and $\mathbf{13}_{4a}$ at their center parts so as to allow limited sliding motions in the lateral direction. The levers 12 and 13 are assembled together, crossing each other, by engaging the protrusions $\mathbf{12}_{2a}$ and $\mathbf{12}_{4a}$ of the first lever 12 correspondingly into these openings $\mathbf{13}_{2a}$ and $\mathbf{13}_{4a}$ of the second lever 13. As they are thus assembled, the third arm part $\mathbf{12}_3$ of the first lever 12 is received in the indentations $\mathbf{13}_{2b}$ and $\mathbf{13}_{4b}$ of the second and fourth arm parts $\mathbf{13}_2$ and $\mathbf{13}_4$ of the second lever 13, and the third arm part $\mathbf{13}_3$ of the second lever 13 is positioned inside the first arm part $\mathbf{12}_1$ of the first lever 12, as shown in FIG. 2.

Supporting walls $\mathbf{12}_{2b}$ and $\mathbf{12}_{4b}$ which are downwardly open are formed outside the center positions of the mutually opposite second and fourth arm parts $\mathbf{12}_2$ and $\mathbf{12}_4$ of the first lever. Protrusions $\mathbf{12}_{2c}$ and $\mathbf{12}_{4c}$ (only the former being shown in FIG. 3) on the lower surfaces of their upper wall for supporting the return springs 14 between protrusions 8*a* formed on the bottom surface of the base member 8. Spring receivers $\mathbf{12}_{2d}$ and $\mathbf{12}_{4d}$ are further formed at the end parts of the second and fourth arm parts $\mathbf{12}_2$ and $\mathbf{12}_4$ of the first lever 12 on the side of the third arm part $\mathbf{12}_3$ for supporting both end parts of the sensing spring 15 between the second lever 13 as will be explained below.

Protrusions $\mathbf{12}_{3a}$ are formed on both end parts of the third arm part $\mathbf{12}_3$ of the first lever 12 in its axial direction for attaching ring-shaped noise suppressing rubber pieces 16. These rubber pieces 16 serve to suppress the noise of collision when the second arm parts $\mathbf{12}_2$ and $\mathbf{13}_2$ and the fourth arm parts $\mathbf{12}_4$ and $\mathbf{13}_4$ of the levers 12 and 13 collide directly with a flange part 11 by the biasing forces of the return springs 14.

An indentation $\mathbf{13}_{3a}$ is formed at a center part of the third arm part $\mathbf{13}_3$ of the second lever 13 for accepting a tongue-shaped operation piece 17 of the leaf switch 6. The aforementioned indentations $\mathbf{13}_{2b}$ and $\mathbf{13}_{4b}$ are formed on the second and fourth arm parts $\mathbf{13}_2$ and $\mathbf{13}_4$ of the second lever 13 for receiving both end parts of the third arm parts $\mathbf{12}_3$ of the first lever 12. Protrusions $\mathbf{13}_{1a}$ and $\mathbf{13}_{1b}$ are provided on the inner side at a center position of the first arm part $\mathbf{13}_1$ of the second lever 13 for supporting a center part of the wire-shaped sensing spring 15, the upper protrusion $\mathbf{13}_{1a}$ supporting it from above the lower protrusions $\mathbf{13}_{1b}$ on both sides of it supporting it from below.

Protrusions $\mathbf{13}_{3b}$ are provided on both end parts of the third arm part $\mathbf{13}_3$ of the second lever 13 in its axial direction for attaching ring-shaped noise suppressing rubber pieces 18.

The first and second levers 12 and 13 are thus connected through their second and fourth arm parts $\mathbf{12}_2$, $\mathbf{12}_4$, $\mathbf{13}_2$ and $\mathbf{13}_4$ and are inserted inside the base member 8 together with the return springs 14. In this situation, the first arm parts $\mathbf{12}_1$ and $\mathbf{13}_1$ of the first and second levers 12 and 13 are prevented from being displaced in the operating direction (or the up-down direction) inside a U-shaped containing part of the base member 8 but its horizontal rotational and sliding motions are allowed to a certain extent. By contrast, the third arm parts $\mathbf{12}_3$ and $\mathbf{13}_3$ of the first and second levers 12 and 13 are allowed to be displaced in the direction of operation (the up-down direction) and their return positions by means of the return springs 14 are controlled by means of regulating protrusions $\mathbf{8}_{1a}$ and $\mathbf{8}_{3a}$ formed on the first and third partition walls $\mathbf{8}_1$ and $\mathbf{8}_3$ of the base member 8 adapted to contact the aforementioned third arm parts $\mathbf{12}_3$ and $\mathbf{13}_3$, respectively.

With the link mechanism 4 thus structured with the first and second levers 12 and 13, the third arm parts $\mathbf{12}_3$ and $\mathbf{13}_3$ engagingly connected to the plunger 3 are adapted to undergo a parallel motion in the up-down direction while remaining in a parallel condition with respect to the first arm parts $\mathbf{12}_1$ and $\mathbf{13}_1$ of the levers 12 and 13 such that the plunger 3 can be displaced in the direction of operation parallel to and without tilting with respect to the base member 8. Thus, the push-button switch can be made thinner and since the plunger 3 can be displaced in the proper direction of operation even if the cap 2 attached to the plunger 3 is pressed only at a corner, the user can obtain a good sensation of operation.

The base member 8 is open upward and four partition walls $\mathbf{8}_1$–$\mathbf{8}_4$ are erected at its center so as to form a rectangular container part 19 for containing therein a rectangular circuit board 7 having the leaf switch 6 mounted on its back surface and the chip LED 5 mounted on its front surface. Protrusions $\mathbf{8}_{2a}$ and $\mathbf{8}_{4a}$ (only the latter being shown in FIG. 2) are formed inside at the upper edge parts of the second and fourth partition walls $\mathbf{8}_2$ and $\mathbf{8}_4$ for holding the circuit board 7 inside the container part 19. The first and second levers 12 and 13 are disposed within the space between these four partition walls $8_1$–$8_4$ and a peripheral wall 8*b* surrounds them from outside. The protrusions $8_{1a}$ and $8_{3a}$ are formed each at two positions on the top edge parts outside the first and third partition walls $8_1$ and $8_3$ for regulating the return positions of the third arm parts $12_3$ and $13_3$ of the levers 12 and 13 that are upwardly biased by means of the return springs 14. A cut part 20 is provided at a center part of the third partition wall $8_3$ such that the tongue-shaped operation piece 17 of the leaf switch 6 disposed inside the container part 19 can be extended out from the container part 19 and received by the third arm part $13_3$ of the second lever 13.

Stopper parts 8*c* are provided at top edge parts of the four corners of this base member 8 in order to regulate the upward displacements of the first arm parts $12_1$ and $13_1$ of the levers 12 and 13.

Two screw holes 21 are formed on each of both sides of the base member 8 for attaching this push-button switch 1 to the cover 9.

A cut part 22 is provided on the bottom surface of the base member 8 at a position corresponding to tongue-like extended pieces 3*c* (only one of them being shown in FIG. 2) having the aforementioned hooks 3*b* formed thereon. A rubber sheet 23 is provided at a position corresponding to this cut part 22 so as to suppress the noise of collision as the extended pieces 3*c* on the plunger 3 hit against a chassis (not shown) when the plunger 3 is being operated.

Figure 4:
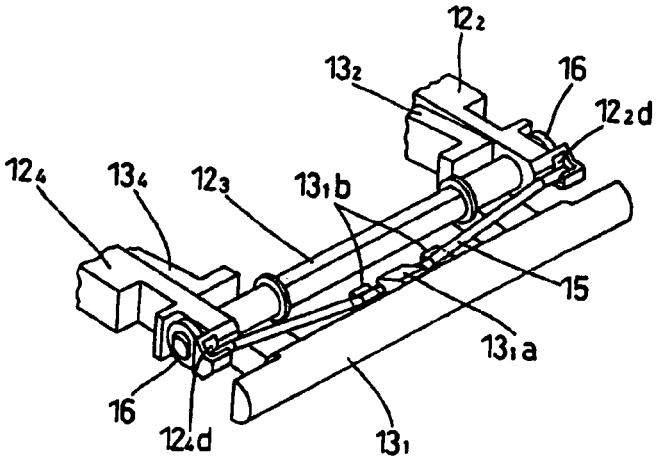
FIG. 4 is a diagonal view of the sensing spring being attached.
Figure 5A:
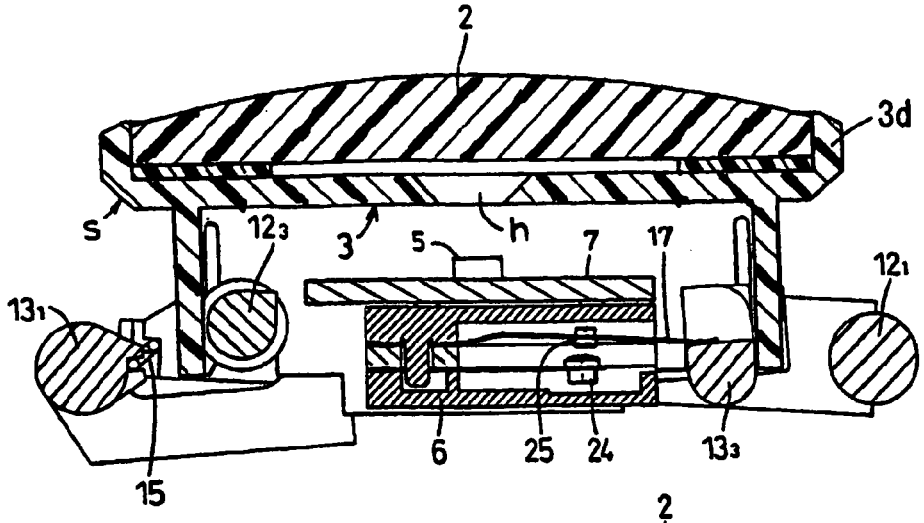
FIGS. 5A, 5B and 5C are sectional views of some essential components for showing movements as the push-button is pressed.
Figure 5B:
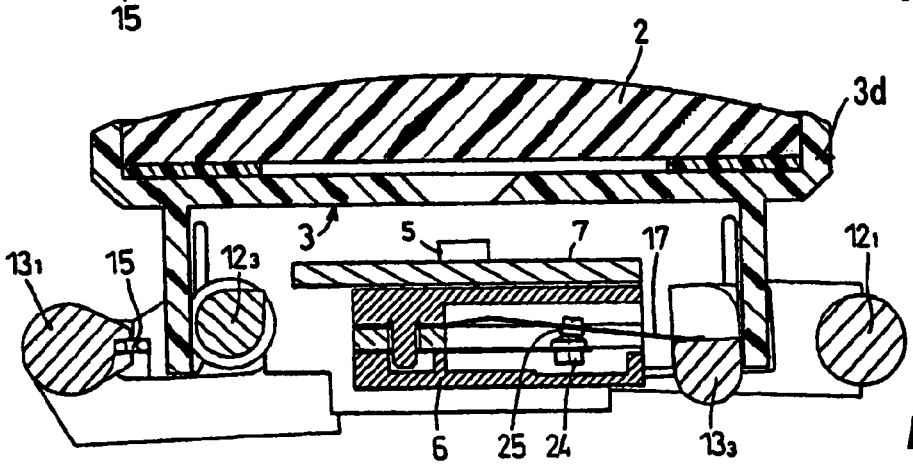
Figure 5C:
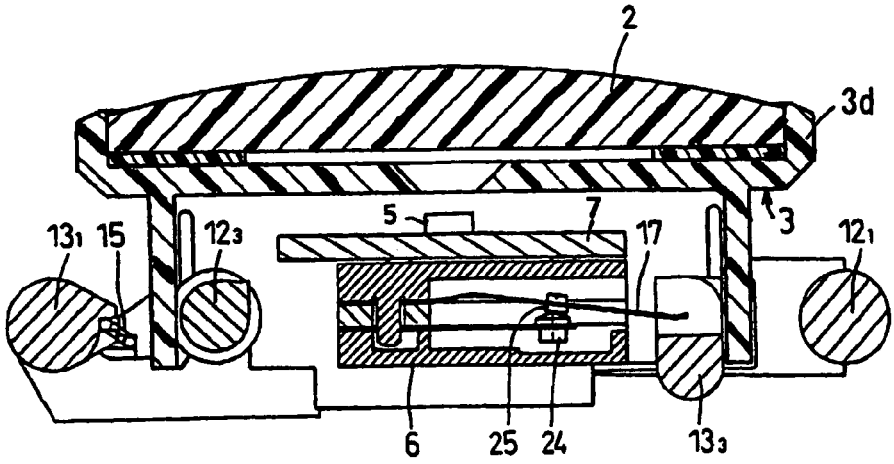

The sensing spring 15 is supported between the third arm part $12_3$ of the first lever 12 and the first arm part $13_1$ of the second lever 13 as shown in FIG. 4. At the return position (or the initial position), it applies a biasing force against the downward displacement of the third arm part $12_3$ as shown in FIG. 5A. As plunger is pressed and the third arm part $12_3$ is displaced downward, its biasing force increases and reaches its maximum strength at an intermediate position at which the third arm part $12_3$ comes closest to the first arm part $13_1$ as shown in FIG. 5B. As this intermediate position is passed and the third arm part $12_3$ is further displaced downward, the biasing force turns to the direction of displacing the third arm part $12_3$ in the downward direction as shown in FIG. 5C. The user thus obtains a realistic sensation of clicking.

Figure 6:
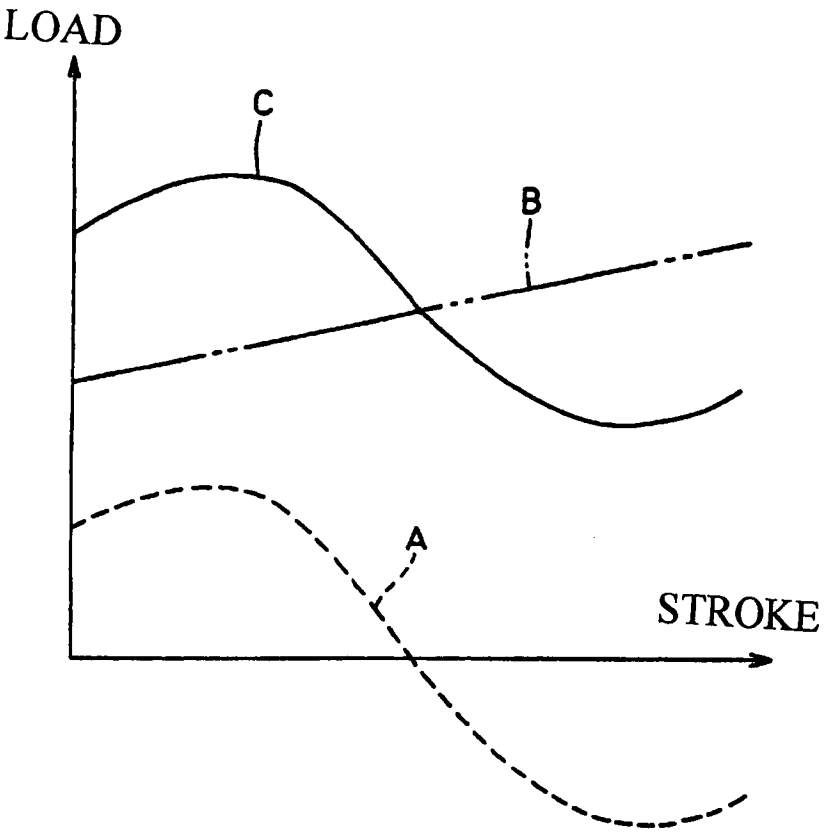
FIG. 6 is a characteristic diagram showing the relationship between the stroke and the load.

FIG. 6 is a characteristic diagram showing the relationship between the stroke and the load for explaining the sensation obtained when the plunger is pressed. As indicated by the broken line A, the load on the sensing spring 15 is inverted in direction at a specified intermediate position as the plunger 3 is pressed. In the meantime, the biasing force on the return springs 14 increases gradually, as indicated by the chain line B. The solid curve C shows the combination of the two and indicates the actual clicking sensation experienced by the user as the plunger 3 is pressed down.

The leaf switch 6 contains inside a fixed terminal 24 and a mobile terminal 25 and is normally in a switched-off condition. The tongue-shaped operation piece 17, to which the mobile terminal 25 is attached, extends to the exterior where it is received and supported by the indentation $13_{3a}$ at the center part of the third arm part $13_3$ of the second lever 13. This third arm part $13_3$ is at the return position by the upward biasing force of the return springs 14. The operation piece 17 is pushed upwards at this return position such that the mobile terminal 25 moves away from the fixed terminal 24 to establish the switched-off condition.

As the plunger 3 at the return position is pressed down through the cap 2, the third arm parts $12_3$ and $13_3$ of the first and second levers 12 and 13 connected to the bottom end part of the plunger 3 are downwardly displaced while remaining parallel to the first arm parts $12_1$ and $13_1$ of both levers 12 and 13, that is, while the plunger 3 remains parallel to the base member 8. As the operation piece 17 of the leaf switch 6 is thereby also displaced further downward and reaches a specified position, the mobile terminal 25 attached to the operation piece 17 contacts the fixed terminal 24 and the switch is turned on. As a result, the LED chip 5 on the upper surface of the circuit board 7 is switched on and an output is made to the exterior. As plunger 3 is released from the pushed condition, it returns to its return position by means of the biasing force of the return springs 14 and the leaf switch is turned off.

In summary, since the plunger 3 is detachably connected to the first and second levers 12 and 13 though its indentation 3*a*, the circuit board 7 is detachably contained and supported in the container part 19 of the base member 8 through the protrusions 82*a* and 84*a*, and the operation piece 17 of the leaf switch 6 on the back surface side of the circuit board 7 is disposed above the second lever 13, the plunger 3 and the circuit board 7 can be easily detached or attached from above and the maintenance work such as exchanging the chip LED 5 and the leaf switch 6 can be effected easily.

Figure 8:
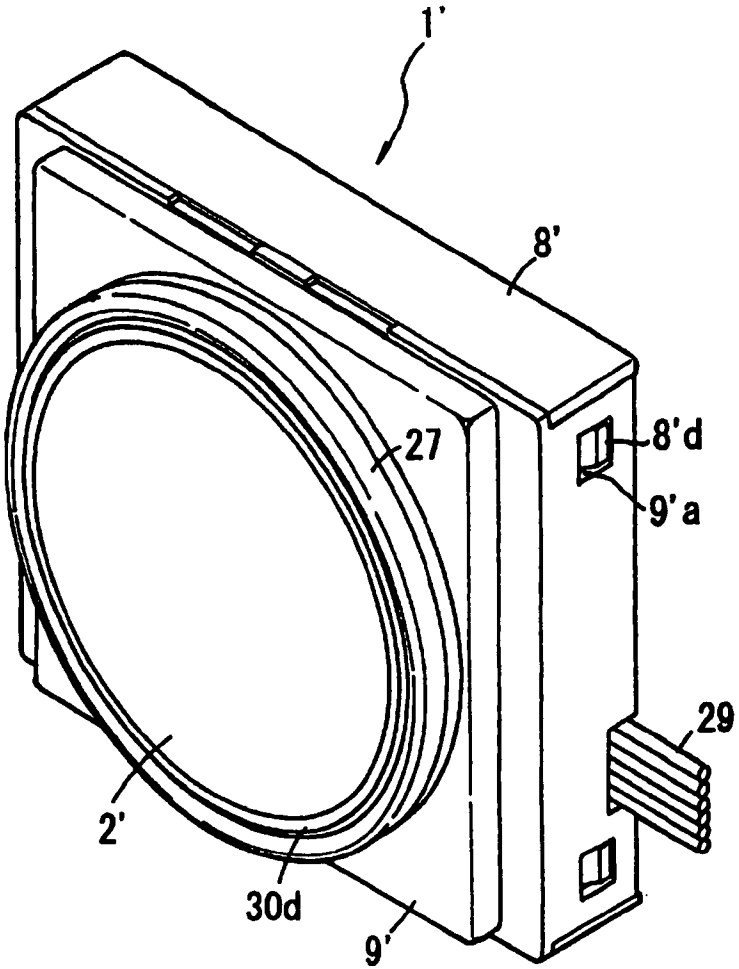
FIG. 8 is a frontal diagonal view of the push-button switch of FIG. 7.
Figure 7:
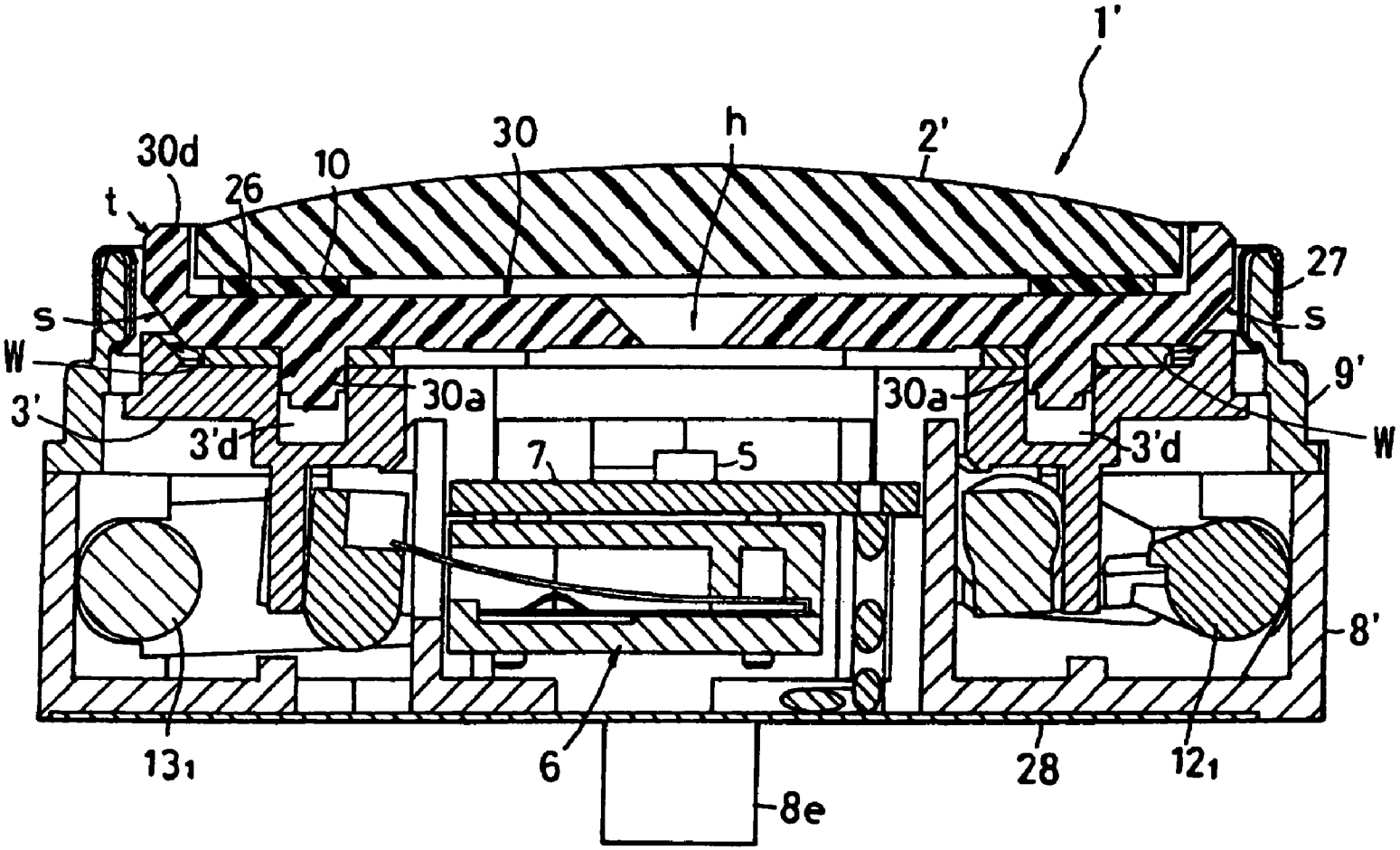
FIG. 7 is a sectional view of another push-button switch according to another embodiment of the invention.
Figure 9:
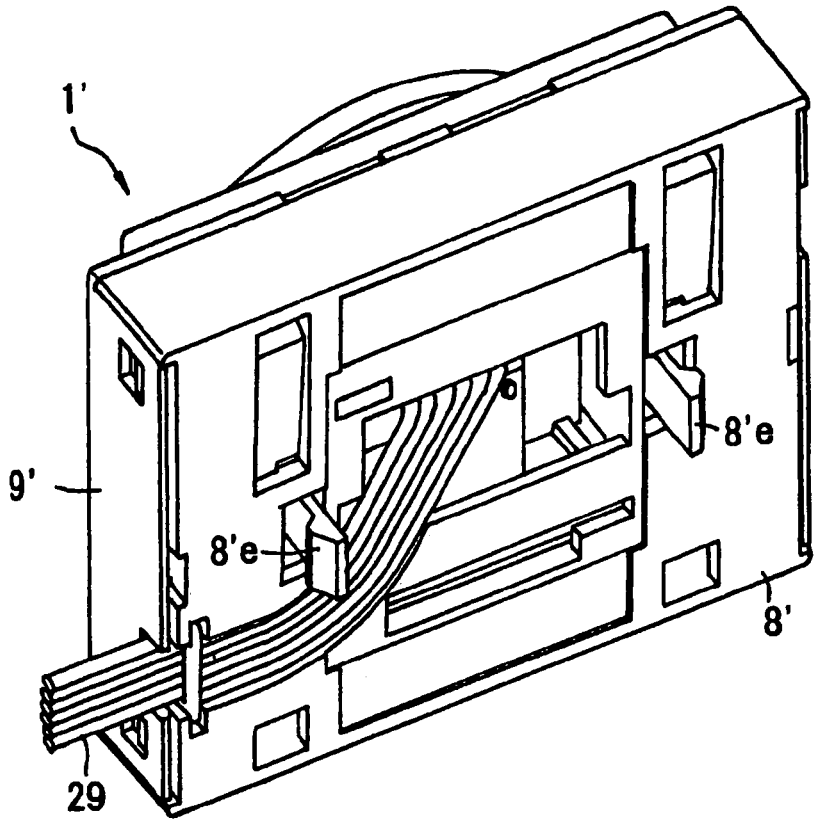
FIG. 9 is a diagonal back view of the push-button switch of FIG. 7 before the attachment of a dust preventing sheet.
Figure 10:
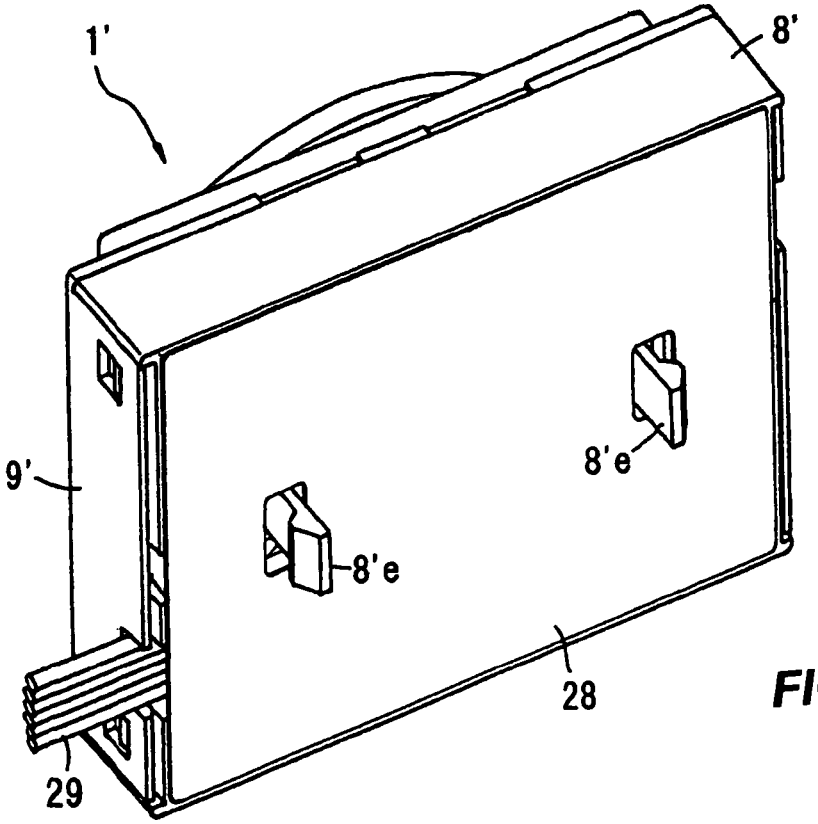
FIG. 10 is a diagonal back view of the push-button switch of FIG. 8 after a dust preventing sheet is attached
Figure 11:
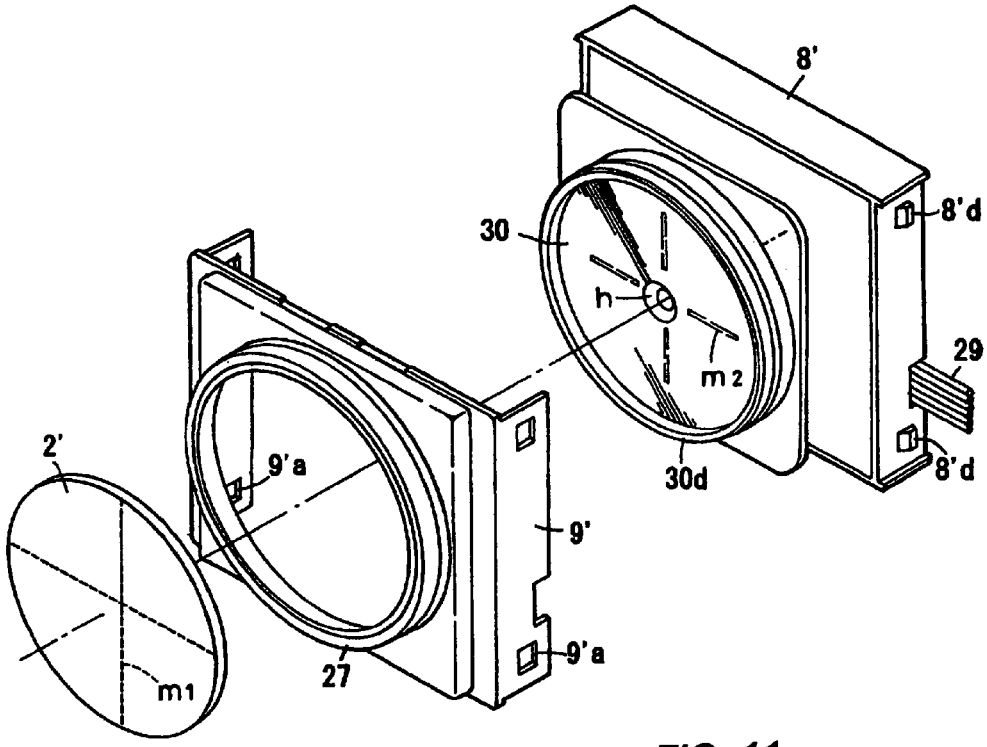
FIG. 11 is an exploded diagonal view of the push-button switch of FIG. 7.

FIG. 7 is a sectional view of another push-button switch 1' according to another embodiment of the invention, FIG. 8 is its frontal diagonal view, FIGS. 9 and 10 are its diagonal back views and FIG. 11 is its exploded diagonal view.

The push-button switch 1' according to this embodiment of the invention is different from the switch 1 described above regarding the button-operating part but its link mechanism for displacing the plunger without tilting and many other principal mechanisms are similar and hence those components having similar functions will be indicated by the same symbols and may not be explained repetitiously.

According to the first embodiment of the invention described above, the light-conducting material for guiding the light from the chip LED 5 to illuminate the outer periphery of the cap 2 was integrally formed as a single piece with the plunger 3. According to the second embodiment, by contrast, the plunger 3' and the lens member 30 serving as the light-conducting member are separately formed. While the operating surface of the cap 2 according to the first embodiment is rectangular, the cap 2' according to the second embodiment has a circular operating surface.

The lens member 30 according to the second embodiment of the invention comprises a transparent resin material such as polycarbonate and is provided with a tapered opening h and a tapered surface s for guiding the light from the chip LED 5 to the upper edge of a frame part 30*d* of the lens member 30, like the lens member according to the first embodiment. The sloping angle of these tapered opening h and the tapered surface s is about 45°, as in the first embodiment of the invention. As explained above, the tapered opening h may be shaped so as to expand downward or may be an indentation, instead of a throughhole.

The plunger 3' according to the second embodiment has a large opening at the center and its upper surface is provided with openings $3'_d$ corresponding to a pair of protrusions 30*a* on the lens member 30 such that they can be engaged. As they are thus correctly positioned with respect to each other, they are affixed to each other by means of an adhesive tape 10.

If the diameter of the opening h through the lens member 30 is too large, the amount of light from the chip LED 5 reflected by its upper surface is reduced. If this diameter is too small, the area of reflection becomes too small. Thus, the diameter of the opening h must be determined according to factors such as the size of the cap 2' and the quantity of light from the chip LED 5. According to one embodiment of the invention, the outer diameter of the cap 2' is 32 mm, the thickness of the lens member 30 is 1.6 mm and the largest part of the diameter of the tapered opening h is 6.2 mm.

A tapered surface t is provided to upper edge of the frame part 30*d* such that the light which is guided from the back surface will be spread around to the frame part 30*d*. The upper edge portions of the frame part 30*d* may be subjected also to an etching process such that light can be diffused even more.

A white reflective surface is further formed on the back side of the operating surface of the cap 2' by pasting a film or by printing such that the light which has passed through the tapered opening h is reflected into the lens member 30 so as to dependably secure the amount of light guided to the frame part 30*d*. The plunger 3' itself may be made of a white resin material such that the light which has passed through the lens member 30 is reflected back into the lens member 30 such that the loss of light can be reduced. The plunger 3' is further provided with a tapered surface w opposite the tapered surface 2 of the lens member 30 such that the light which has passed through the lens member 30 can be reflected back into the lens member 30 so as to secure the amount of light guided to the frame part 30*d*.

Thus, the light from the chip LED 5 is effectively guided to the frame part 30*d* which surrounds the operating surface of the cap 2' by means of the lens member 30 with the tapered opening h and the tapered surface s.

According to an embodiment illustrated in FIG. 11, furthermore, a black cross mark m1 is formed, say, by printing on a white background on the back surface of the cap 2'. Another cross mark m2 is formed for position-matching on the lens member 30. When the user is about to set a cap 2' with a different surface design to the lens member 30, the cap 2' can be set in the correction direction by merely matching these marks m1 and m2.

In FIG. 11, numeral 27 indicates a metallic cosmetic ring, say, of a stainless steel material adapted to be fitted from outside to the outer peripheral edge of a cover 9' to surround the frame part 30*d* so as to provide an elegant overall appearance. The cover 9' is adapted to be connected to a base member 8' by means of engaging hooks $\mathbf{8'}_d$ and engaging holes $\mathbf{9'}_a$. In order to insert the push-button switch 1' into the operation panel on the wall of an elevator hall, for example, engaging hooks $\mathbf{8'}_e$ protrude backwards from the back surface of the base member 8', as shown in FIG. 9. In FIG. 10, numeral 28 indicates a dust preventing sheet with which the back surface of the base member 8' is closed.

Figure 12A:
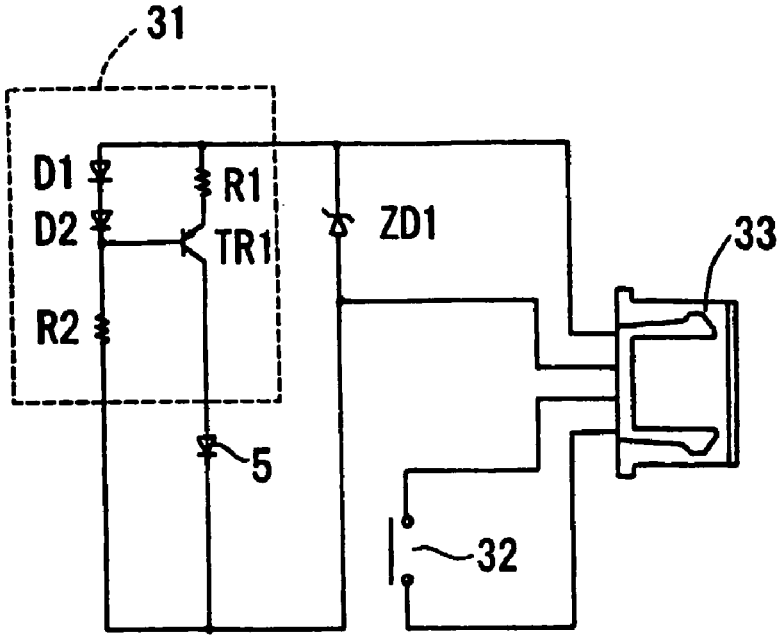
FIGS. 12A and 12B are circuit diagrams of the push-button switch.
Figure 12B:
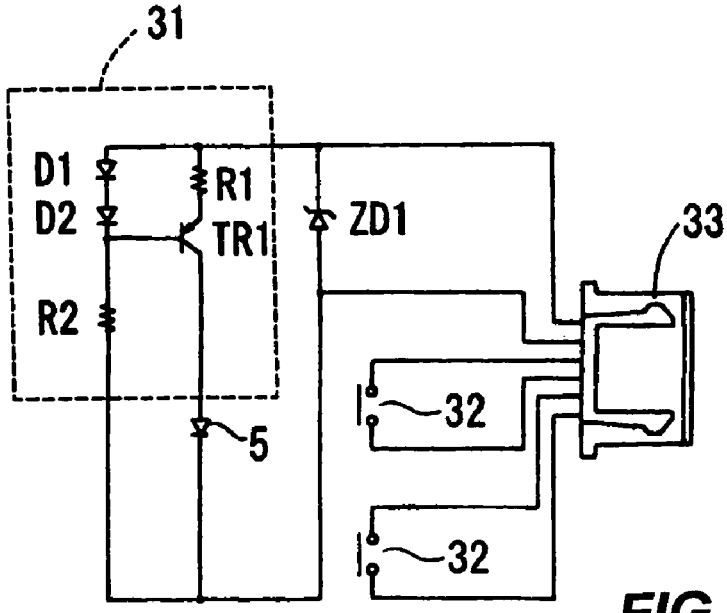

The push-button switch 1' as described above may be of a type provided with a lead line 29 with two power lines for illumination and two signal lines, as illustrated by FIG. 12A or of a type provided with a lead line 29 with two power lines for illumination and four signal lines as illustrated by FIG. 12B. In FIGS. 12A and 12B, numeral 31 indicates a constant-current circuit comprising diodes D1 and D2, a transistor TR1 and resistors R1 and R2, ZD1 indicates a Zener diode for protecting the chip LED 5 by absorbing a surge current, numeral 32 indicates a junction point for the leaf switch 6 and numeral 33 indicates a connector.

Although the invention has been described above by way of two examples, these examples are not intended to limit the scope of the invention. Many modifications and variations are possible within the scope of the invention. Although examples using a single chip LED 5 have been illustrated, two chip LEDs 5 may be disposed next to each other at the center part of the plunger 3 and the lens member 30, especially where a large quantity of light is required. The frame part and the optical path for guiding light to the frame part need not be integrally formed. They may be comprised of different materials. A liquid crystal or optical fibers may alternatively be used for frame illumination. The sensing spring 15 may comprise a compressive coil spring. Instead of a leaf switch, use may be made of a microswitch or a switch of another type.

In summary, the push-button switch of this invention is characterized as illuminating the frame around the push button and hence switches with improved design can be provided. Moreover, since the light from a light source is guided to the frame part surrounding the outer periphery, only a small number of light sources such as chip LEDs are required and this results in the reduced production cost.

What is claimed is:

1. A push-button switch comprising:

a switch main body supported by a base member;

a pressing member having an operating surface with an outer periphery;

a plunger connected to said pressing member for activating said switch main body by a pressing operation on said pressing member in an operating direction;

a light source; and a light-guiding member having a frame part that surrounds said outer periphery of said operating surface for guiding light from said light source to said frame part;

wherein said light source is disposed opposite a center part on a back surface of said operating surface of said pressing member, said light-guiding member being disposed between said light source and said back surface.

2. The push-button switch of claim 1 wherein said light-guiding member comprises a transparent resin material.

3. The push-button switch of claim 2 wherein said light-guiding member has a reflecting surface which reflects the light from said light source and guides to said frame part.

4. The push-button switch of claim 3 wherein said light-guiding member has a tapered opening which serves as said reflecting surface, said tapered opening serving to reflect said light from said light source to an outer peripheral part of said back surface.

5. The push-button switch of claim 4 wherein said light-guiding member has a tapered surface on an outer peripheral part, said tapered surface serving as said reflecting surface, said tapered surface serving to reflect the light reflected by said tapered opening and guided to the outer peripheral part of said back surface to the side of said operating surface.

6. The push-button switch of claim 2 wherein said light-guiding member has an indentation surrounded by said frame part, said pressing member is contacted to said indentation, said back surface of said pressing member and said indentation in said light-guiding member are each provided with a positioning mark.

7. The push-button switch of claim 1 wherein said plunger and said light-guiding member are integrally formed as a single piece whereby said plunger also comprises the material of said light-guiding member.

8. The push-button switch of claim 7 further comprising:

a first lever with one end supported by said base member and the other end being connected to said plunger; and a second lever with one end supported by said base member and the other end being connected to said plunger;

wherein middle parts of said first lever and said second lever are crossed such that said first and second levers are assembled and said other ends are allowed to be displaced in said operating direction while remaining parallel to said one end, wherein one of said levers is provided with a spring member adapted to be elastically deformed as said plunger is displaced.

9. The push-button switch of claim 8 wherein said first lever and said second lever each comprise a first arm part, a second arm part, a third arm part and a fourth arm part that are sequentially connected and together form a rectangular shape; said first arm part being at said one end; said third arm part being opposite said first arm part and at said other end; said first lever and said second lever being assembled together by being crossed at center parts of said second arm parts and said fourth arm parts such that the third arm part of one of said levers is positioned between the first arm part and the third arm part of the other of said levers; said levers being biased by return springs against said pressing operation; said plunger being detachably connected to the third arm parts of both of said levers and displaced in said operating direction as the third arm parts move upward and downward; said base member having a container part inside a region partitioned by both of said assembled levers for removably containing therein a circuit board to which said light source is mounted.

10. The push-button switch of claim 9 further comprising a leaf switch on a back surface of said circuit board serving as a main body of said push-button switch, said leaf switch having an operation piece that is operated by the third arm part of either of said first lever and said second lever.

11. The push-button switch of claim 9 wherein said spring member is disposed between the first arm part of one of said levers and the third arm part of the other of said levers and is adapted to have the biasing direction inverted as said third arm part is displaced by said pressing operation of said plunger.

12. The push-button switch of claim 1 further comprising:

a first lever with one end supported by said base member and the other end being connected to said plunger; and a second lever with one end supported by said base member and the other end being connected to said plunger;

wherein said first and second levers are assembled with middle parts of said first lever and said second lever crossed and said other ends are allowed to be displaced in said operating direction while remaining parallel to said one end, wherein one of said levers is provided with a spring member adapted to be elastically deformed as said plunger is displaced.

13. The push-button switch of claim 12 wherein said first lever and said second lever each comprise a first arm part, a second arm part, a third arm part and a fourth arm part that are sequentially connected and together form a rectangular shape; said first arm part being at said one end; said third arm part being opposite said first arm part and at said other end; said first lever and said second lever being assembled together by being crossed at center parts of said second arm parts and said fourth arm parts such that the third arm part of one of said levers is positioned between the first arm part and the third arm part of the other of said levers; said levers being biased by return springs against said pressing operation; said plunger being detachably connected to the third arm parts of both of said levers and displaced in said operating direction as the third arm parts move upward and downward; said base member having a container part inside a region partitioned by both of said assembled levers for removably containing therein a circuit board to which said light source is mounted.

14. The push-button switch of claim 13 further comprising a leaf switch on a back surface of said circuit board serving as a main body of said push-button switch, said leaf switch having an operation piece that is operated by the third arm part of either of said first lever and said second lever.

15. The push-button switch of claim 13 wherein said spring member is disposed between the first arm part of one of said levers and the third arm part of the other of said levers and is adapted to have the biasing direction inverted as said third arm part is displaced by said pressing operation of said plunger.

* * * * *